US008882153B2

(12) United States Patent
Windorski

(10) Patent No.: US 8,882,153 B2
(45) Date of Patent: Nov. 11, 2014

(54) RECESSED ADHESIVE BINDING SYSTEMS

(75) Inventor: David C. Windorski, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 22 days.

(21) Appl. No.: 13/882,746

(22) PCT Filed: Dec. 20, 2011

(86) PCT No.: PCT/US2011/065955

§ 371 (c)(1), (2), (4) Date: May 1, 2013

(87) PCT Pub. No.: WO2012/087994

PCT Pub. Date: Jun. 28, 2012

(65) Prior Publication Data

US 2013/0328299 A1 Dec. 12, 2013

Related U.S. Application Data

(60) Provisional application No. 61/425,831, filed on Dec. 22, 2010.

(51) Int. Cl.

| | |
|---|---|
| ***B42D 1/10*** | (2006.01) |
| ***B42C 9/00*** | (2006.01) |
| ***B42F 15/00*** | (2006.01) |

(52) U.S. Cl.

CPC ..... *B42D 1/10* (2013.01); *B42C 9/0081* (2013.01); *B42F 15/0017* (2013.01); *Y10S 402/50* (2013.01)

USPC ..... 281/22; 281/21.1; 281/45; 402/500; 402/8

(58) Field of Classification Search

CPC ..... B42D 1/10

USPC ..... 281/22–24, 45, 21.1; 402/8, 500; 24/67 AR

See application file for complete search history.

(56) References Cited

U.S. PATENT DOCUMENTS

| | | | | |
|---|---|---|---|---|
| 191,424 | A * | 5/1877 | Harper | 281/23 |
| 2,979,840 | A | 4/1961 | Eastman | |

(Continued)

FOREIGN PATENT DOCUMENTS

| | | |
|---|---|---|
| JP | 6171270 | 6/1994 |
| JP | 3101251 | 8/2000 |

(Continued)

OTHER PUBLICATIONS

International Search Report PCT/US2011/065955 Mar. 26, 2012, 3 pgs.

*Primary Examiner* — Kyle Grabowski
(74) *Attorney, Agent, or Firm* — Nicole J. Einerson

(57) ABSTRACT

Recessed adhesive binding systems. One system can include a plurality of sheets arranged in a stack, each of the plurality of sheets having a front surface, a rear surface, and an exposed edge. At least one of the front surface and the rear surface of each of the plurality sheets can include at least one recessed adhesive positioned adjacent the exposed edge to form an at least partially exposed recessed adhesive, which can be selectively activated. The rear surface of a first sheet in the plurality of sheets can be positioned adjacent the front surface of a second sheet in the plurality of sheets, or vice versa, and the exposed edges of the plurality of sheets can be staggered, such that the exposed edge of the second sheet extends further outwardly from the stack than the exposed edge of the first sheet in the stack.

18 Claims, 4 Drawing Sheets

(56) References Cited

U.S. PATENT DOCUMENTS

| | | | | |
|---|---|---|---|---|
| 3,691,140 | A | 9/1972 | Silver | |
| 3,857,731 | A | 12/1974 | Merrill, Jr. | |
| 3,900,642 | A | 8/1975 | Michel | |
| 4,166,152 | A | 8/1979 | Baker | |
| 5,344,693 | A | 9/1994 | Sanders | |
| 5,458,938 | A | 10/1995 | Nygard | |
| 5,524,929 | A * | 6/1996 | Emmel et al. | 281/23 |
| 5,524,998 | A | 6/1996 | Schwartz | |
| 5,571,617 | A | 11/1996 | Cooprider | |
| 5,744,207 | A | 4/1998 | Bartusiak | |
| 5,824,748 | A | 10/1998 | Kesti | |
| 5,874,144 | A | 2/1999 | Kumar | |
| 5,876,817 | A | 3/1999 | Mathna | |
| 5,906,883 | A | 5/1999 | Blanc-Brude | |
| 6,149,304 | A | 11/2000 | Hamilton | |
| 6,352,766 | B1 | 3/2002 | Crandall | |
| 6,420,480 | B1 | 7/2002 | Ozdeger | |
| 6,858,285 | B1 | 2/2005 | Hamilton | |
| 6,911,243 | B2 | 6/2005 | Sher | |
| 7,040,051 | B2 | 5/2006 | Windorski | |
| 7,225,570 | B2 | 6/2007 | Windorski | |
| 7,326,453 | B2 | 2/2008 | Windorski | |
| 7,674,345 | B2 | 3/2010 | Graham | |
| 7,735,872 | B1 * | 6/2010 | Arkwright | 281/21.1 |
| 2002/0179237 | A1 | 12/2002 | Inagaki | |
| 2005/0170174 | A1 * | 8/2005 | Windorski | 428/343 |
| 2005/0276971 | A1 | 12/2005 | Kitchin | |
| 2006/0188710 | A1 | 8/2006 | Windorski | |
| 2006/0210792 | A1 * | 9/2006 | Windorski et al. | 428/343 |
| 2008/0063842 | A1 | 3/2008 | Callinan | |
| 2008/0138591 | A1 | 6/2008 | Graham | |

FOREIGN PATENT DOCUMENTS

| | | |
|---|---|---|
| WO | WO 2012/087995 | 6/2012 |
| WO | WO 2012/087996 | 6/2012 |
| WO | WO 2013/036463 | 3/2013 |
| WO | WO 2013/036475 | 3/2013 |

* cited by examiner

RECESSED ADHESIVE BINDING SYSTEMS

FIELD

The present disclosure generally relates to binding systems that can be used for filing, organizing and/or displaying elements, such as paper, and particularly, to binding systems employing recessed adhesive zones that can be selectively activated, and more particularly, to binding systems employing recessed adhesive zones and arranged in a staggered configuration.

BACKGROUND

Some existing binders, or binding systems, use metal or plastic brackets, brads, or the like to file, organize, or display sheets of paper in a desired manner. Such binders typically require holes to be punctured in the sheets of paper. Other binding systems may allow paper to be slid between two rigid and opposing surfaces without puncturing the paper; however, such binding systems typically cannot support very many sheets of paper. In addition, with some binding systems, it can be cumbersome or difficult to rearrange the paper after it has been bound with the binding system.

SUMMARY

The recessed adhesive binding systems of the present disclosure afford easy-to-use and attractive filing, organizing, and/or displaying of various articles, such as paper, envelopes, or the like. The binding systems can allow for facile re-arrangement of items after the items have been bound with the binding system, and can bind various items without damaging such items. In some embodiments, the binding systems can be employed as wall hangings for organizing and/or displaying tasks; to-do lists; projects; notes; envelopes comprising articles such as coins, stamps, or the like; as well as other suitable items desired to be organized and/or displayed. In addition, in some embodiments, the binding systems can be employed in folders, such as file folders, hanging files, or the like, in which the items to be displayed can be arranged in a book or binder configuration.

Some embodiments of the present disclosure provide a recessed adhesive binding system. The system can include a plurality of sheets arranged in a stack having a binding, each of the plurality of sheets having a front surface, a rear surface, and an exposed edge. Each of the plurality of sheets can be configured to pivot about the binding. At least one of the front surface and the rear surface of each of the plurality sheets can include at least one recessed adhesive positioned adjacent the exposed edge to form an at least partially exposed recessed adhesive, which can be selectively activated. The rear surface of a first sheet in the plurality of sheets can be positioned adjacent the front surface of a second sheet in the plurality of sheets, and the exposed edges of the plurality of sheets can be staggered, such that the exposed edge of the second sheet extends further outwardly from the stack than the exposed edge of the first sheet in the stack.

Other features and aspects of the present disclosure will become apparent by consideration of the detailed description and accompanying drawings.

DETAILED DESCRIPTION

Figure 1:
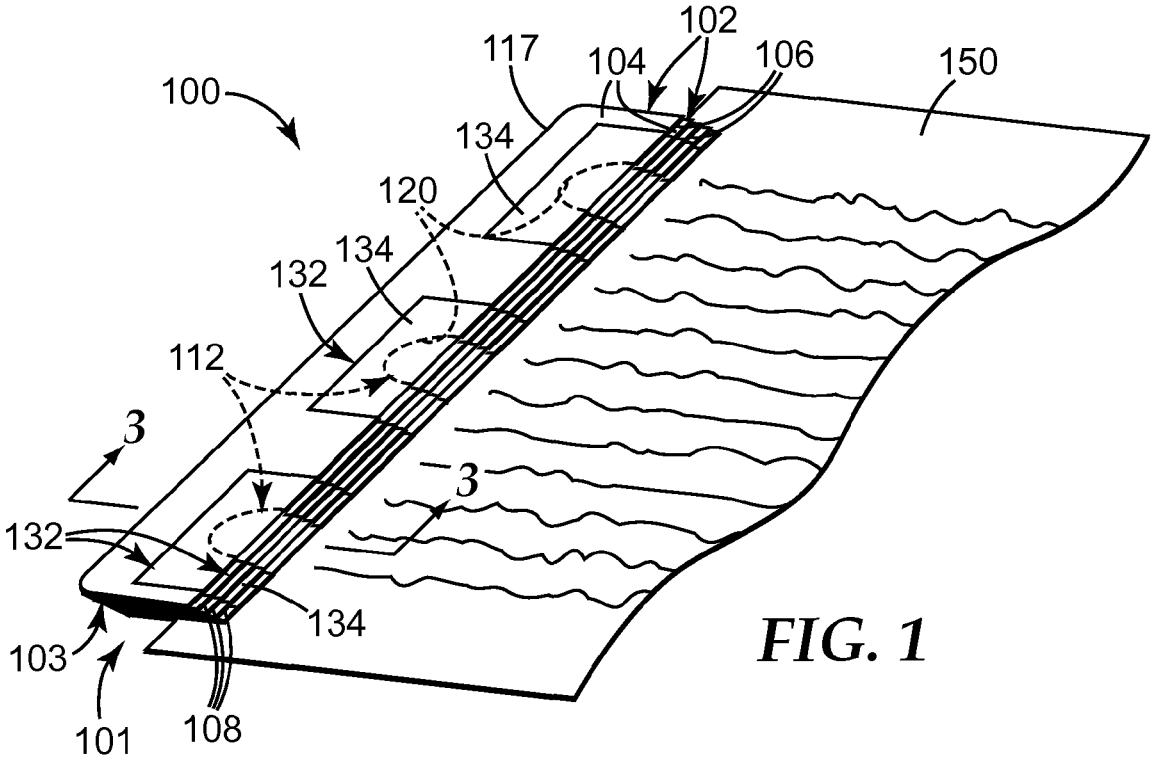
FIG. 1 is a front perspective view of a recessed adhesive binding system according to one embodiment of the present disclosure, a sheet of paper shown bound by the binding system.

Before any embodiments of the present disclosure are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "supported," and "coupled" and variations thereof are used broadly and encompass both direct and indirect mountings, supports, and couplings. It is to be understood that other embodiments may be utilized, and structural or logical changes may be made without departing from the scope of the present disclosure. Furthermore, terms such as "front," "rear," "first," "second," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

The present disclosure generally relates to adhesive binding systems, and particularly, to recessed adhesive binding systems, having sheets stacked on top of one another in a staggered configuration, such that the binding systems can be bound together in a facile manner, and such that articles bound by the binding systems can be aesthetically arranged, organized, and/or displayed in the binding system. For example, existing stacks or notepads in which individual sheets have adhesive thereon, are generally arranged or configured such that the adhesive of one sheet contacts another sheet in the stack while in the stacked configuration, and when a sheet is removed from the stack, the sheet can be adhered to another desired surface (e.g., as a label, note, or the like). However, in the binding systems of the present disclosure, the sheets are not necessarily intended to be removed and the adhesive on each sheet in a stack is not necessarily configured to adhere one sheet in the stack to another sheet in the stack, but rather to adhere various articles to the binding system, so as to file, organize, arrange, and/or display the articles. Generally, the binding systems of the present disclosure employ recessed adhesive zones or areas, such that the adhesive regions are selectively activated to adhere various articles when desired, but not necessarily to adhere to one another or to other surfaces with which the binding system comes into contact. As a result, an object or article (e.g., a sheet of paper) can be bound by the adhesive binding system by pressing (e.g., with sufficient pressure) one or both of the recessed adhesive and the object into contact. Because the adhesive is recessed, it is selectively activated in that it does not substantially bind to objects until desired, and until activated (e.g., pressed).

The adhesive binding systems of the present disclosure can be used in a variety of applications, including but not limited to, one or more of hanging files, file folders, in purses, in wallets, as a wallet organizer for credit cards, inside three-ring binders, as wall displays or organizers, in desk drawers, in books (e.g., textbooks), as a refrigerator door organizer, in lockers, other suitable applications, or combinations thereof. For example, the binding systems of the present disclosure can be used to organize a variety of objects, such as papers, shopping coupons, notes or messages, tasks, to-do lists, calendars, projects, recipe cards (e.g., while cooking), other suitable objects, or combinations thereof. In some embodiments, the binding systems can be color-coded, for example, such that multiple binding systems can be employed at one time, each binding system designated for a different use, purpose, project, or the like.

The adhesive binding systems of the present disclosure can hold a variety of lightweight articles, materials or items, including, but not limited to, one or more of papers, photographs, envelopes, newspaper articles, credit cards, paperclips, coins, stamps, thumbtacks, writing utensils, erasers, small tools (e.g., small screwdrivers or Allen wrenches), fasteners (e.g., nails, screws, brads, rivets, etc.), art supplies (e.g., crayons, colored pencils, paintbrushes, etc.), coupons, bills, other suitable lightweight articles, or combinations thereof. In some embodiments, a "lightweight" article is one that weighs less than about 50 g, in some embodiments, less than about 20 g, in some embodiments, less than about 10 g, and in some embodiments, less than about 5 g.

Figure 2:
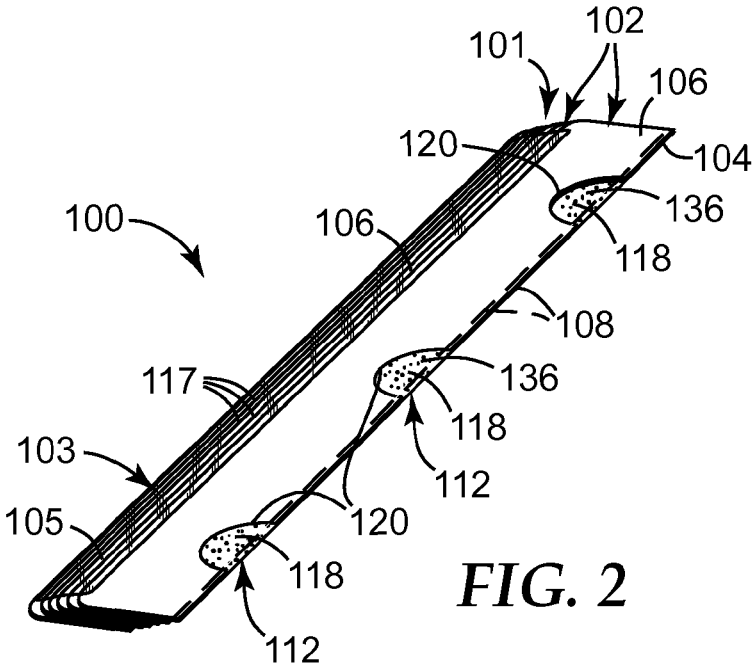
FIG. 2 is a rear perspective view of the recessed adhesive binding system of FIG. 1, with the sheet of paper removed for clarity.
Figure 3:
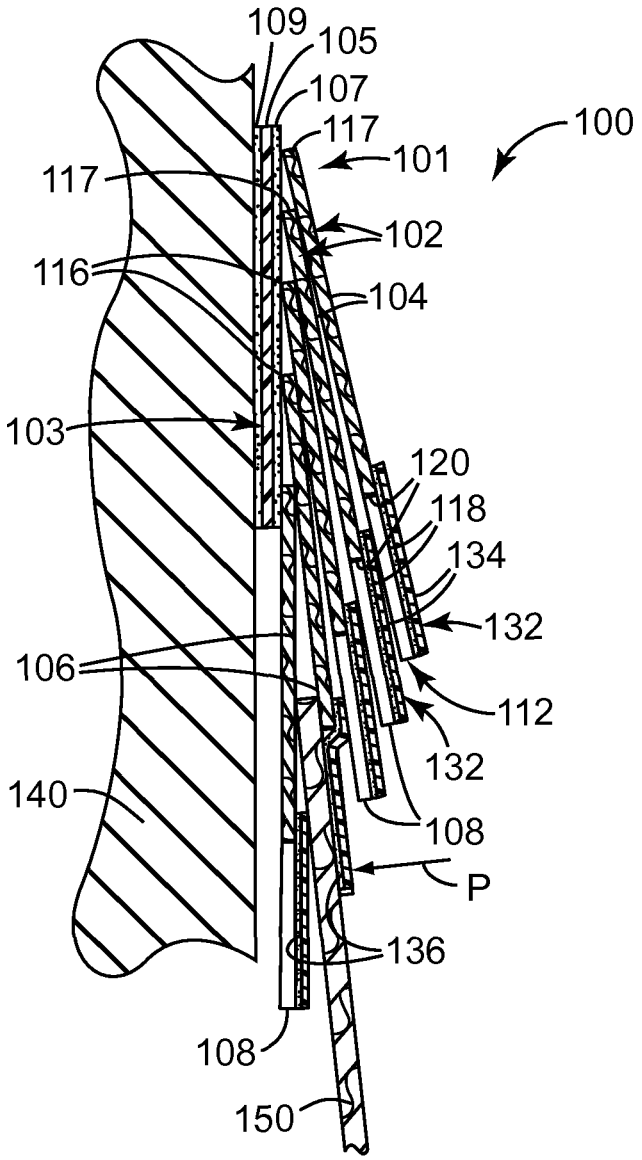
FIG. 3 is a side cross-sectional view of the recessed adhesive binding system of FIGS. and 2, taken along line 3-3 of FIG. 1, the recessed adhesive binding system shown coupled to a vertical mounting surface.

FIGS. 1-3 illustrate a recessed adhesive binding system 100 according to one embodiment of the present disclosure, FIGS. 1 and 3 illustrating the recessed adhesive binding system 100 with a supported article 150 (e.g., a sheet of paper, envelope, etc.) bound in the recessed adhesive binding system 100. Other recessed adhesive binding systems are disclosed in U.S. Patent Application No. 61/425,838, filed Dec. 22, 2010, the disclosure of which is incorporated herein by reference in its entirety. Examples of types of recessed adhesives that can be employed in the recessed adhesive binding systems of the present disclosure are described in U.S. Pat. No. 7,326,453 (Windorski) and U.S. Patent Publication No. 2006/0188710 (Windorski et al.), each of which is incorporated herein by reference in its entirety.

FIG. 1 shows the recessed adhesive binding system 100 in a horizontal configuration (e.g., how the recessed adhesive binding system 100 might be positioned atop a desktop, in a book, in a folder, or the like), and FIG. 3 shows the recessed adhesive binding system 100 in a vertical configuration, for example, mounted to a vertical mounting surface or object 140, such as a wall.

As shown in FIGS. 1-3, the recessed adhesive binding system 100 includes a plurality of sheets 102 (which can also be referred to as "base sheets" or "base layers") arranged in a stack 101 (or stacked configuration) having a binding 103. In some embodiments, the number of sheets 102 in the recessed adhesive binding system 100 can dictate how many articles can be bound in one recessed adhesive binding system 100, and generally how "thick" the recessed adhesive binding system 100 is.

Each sheet 102 can include a front surface 104, a rear surface 106, and an exposed edge 108, wherein the rear surface 106 of each sheet 102 is positioned adjacent the front surface 104 of an adjacent sheet 102 (i.e., except for an end sheet 102). Each sheet 102 can also be configured to pivot with respect to the binding 103, such that each sheet 102 can be flipped open (e.g., when positioned or mounted horizontally (e.g., flat), such as in a book) or upside-down (e.g., when mounted vertically, as in FIG. 3).

For example, as shown in FIG. 3, each sheet 102 can be coupled to the binding 103 via one or more living hinges 116, and each sheet 102 can be pivoted with respect to the other sheets 102 and the binding 103 about the living hinge 116. In some embodiments, the living hinge 116 can be formed at least partially by an adhesive 107 of the binding 103. At least one of the front surface 104 and the rear surface 106 of each of the plurality sheets 102 can include one or more recessed adhesive zones 112 positioned adjacent the exposed edge 108.

The binding 103 of FIGS. 1-3 as well as the binding 203 of FIGS. 4-5 (described below) are shown merely for illustrative purposes and are not intended to be limiting. It should be understood that a variety of types of binding can be employed in the recessed adhesive binding systems of the present disclosure without departing from the spirit and scope of the present disclosure.

Each sheet 102 can be formed of a variety of materials, including, but not limited to, one or more of paper, cardstock, cardboard, plastic film, other suitable materials, or a combination or laminate thereof. In some embodiments, the front surface 104 of the sheet 102 can be colored (e.g., stained, coated, dyed, etc.) for an attractive appearance, for example, that affords high contrast to the recessed adhesive binding system 100 and articles to be bound, mounted, and/or displayed by the recessed adhesive binding system 100.

In some embodiments, the front surface 104 of each sheet 102 can be configured to receive (i.e., be receptive to) ink, print, toner, marks, or the like, such that the front surface 104 can be writable, printable, and/or stainable and can serve as a writing surface, a printing surface, or the like.

The binding 103, in the embodiment shown in FIGS. 1-3, can be formed of a variety of materials, including, but not limited to, one or more of paper, cardstock, cardboard, plastic film (e.g., mylar), binding compound, other suitable materials, any of the above listed materials comprising an adhesive coating on its rear surface to couple the binding 103 across a binding edge 117 of each sheet 102, or a combination thereof. For example, in the embodiment illustrated in FIG. 3, the binding 103 is formed by a backing (or "backing layer") 105 (e.g., formed of mylar) and including a layer of adhesive (e.g., a pressure-sensitive adhesive) 107 adhering the backing 105 to the plurality of binding edges 117 in the stack 101. As shown in FIG. 2, in some embodiments, the backing 105 can have a length substantially equal to, or slightly less than, the length of each of the sheets 102, and a width that is substantially shorter than the width of the each sheet 102, but large enough to contact the plurality of binding edges 117. In some embodiments, for example, as shown in FIGS. 4-5, the binding 103 can overlap at least a portion of one or more sheets 102 in the stack 101, and/or can be formed of a pliable or flexible material so as to accommodate flipping sheets 102 open and away from other sheets 102 in the stack 101.

As shown in FIG. 3, in some embodiments, the recessed adhesive binding system 100 can be coupled to the vertical mounting surface or object 140 using a variety of known means, such as adhesives, nails, removable adhesive systems available under the trade designation "COMMAND" from 3M Company, St. Paul, Minn., or the like, or combinations thereof. By way of example only, an adhesive 109 is illustrated in FIG. 3 as a means for coupling the recessed adhesive binding system 100 to the vertical mounting surface 140.

As shown in FIGS. 1-3, the recessed adhesive binding system 100 of the present disclosure can include the plurality of sheets 102 stacked in a staggered configuration such that the exposed edge 108 of each sheet 102 in the stack 101 extends further outwardly from the stack 101 (e.g., from the binding 103) than the exposed edge 108 of an adjacent sheet 102. For example, in the embodiment shown in FIGS. 1-3, the exposed edge 108 of a lower (e.g., second) sheet 102 in the stack 101 extends further outwardly from the stack 101 than an upper (e.g., first) sheet 102 in the stack 101, such that the uppermost sheet 102 in the stack 101 extends the smallest distance out of the stack 101, and the lowermost sheet 102 in the stack 101 extends the largest distance out of the stack 101. However, the opposite configuration can be employed.

Figure 4:
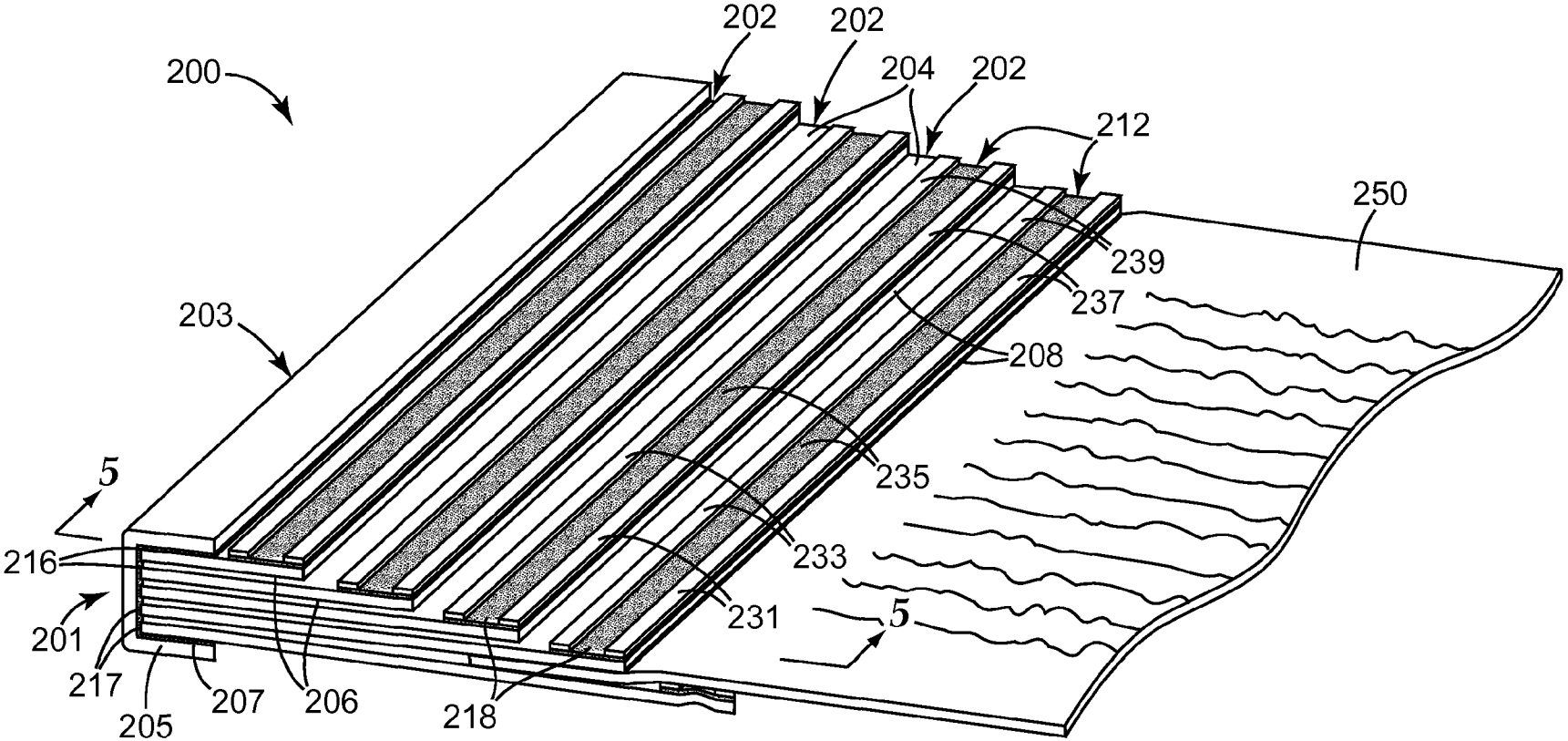
FIG. 4 is a front perspective view of a recessed adhesive binding system according to another embodiment of the present disclosure, a sheet of paper shown bound by the binding system.
Figure 5:
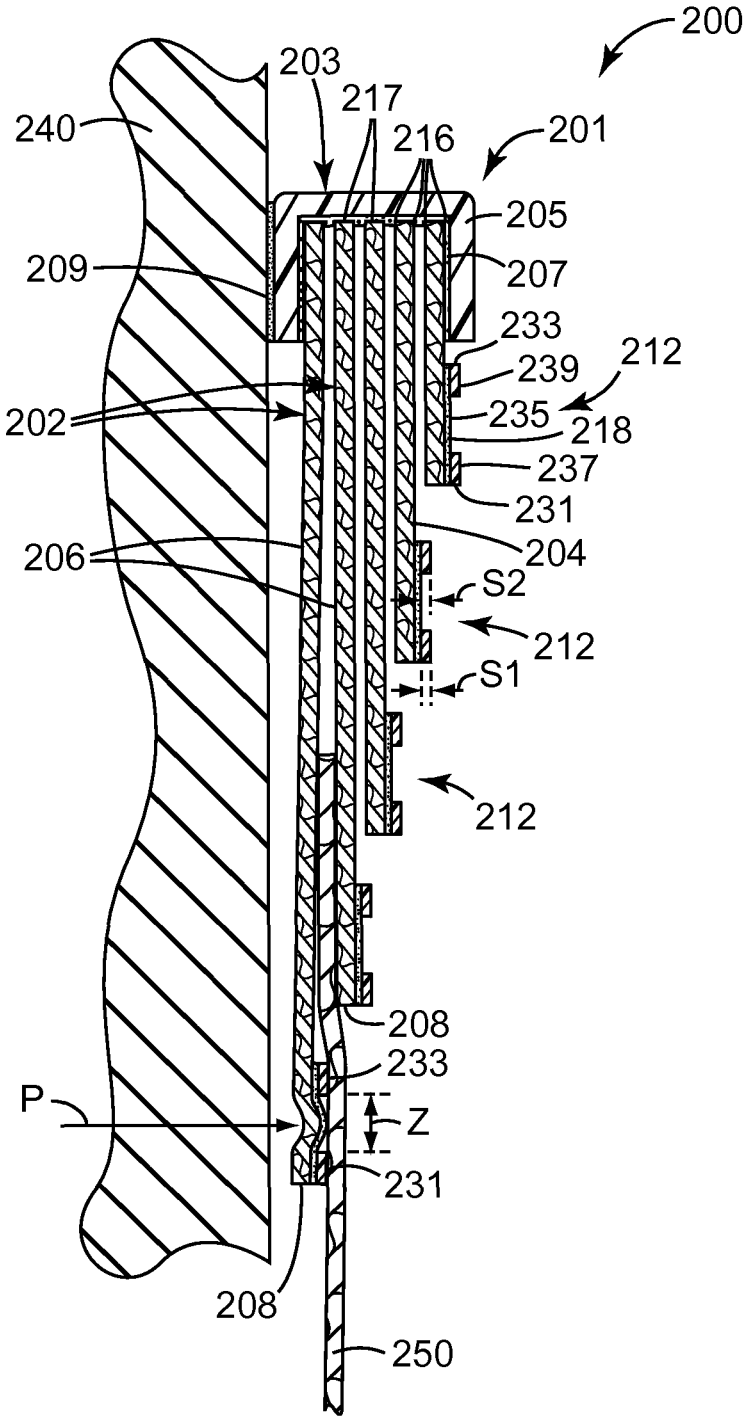
FIG. 5 is a side cross-sectional view of the recessed adhesive binding system of FIG. 4, taken along line 5-5 of FIG. 4, the recessed adhesive binding system shown coupled to a vertical mounting surface.

In some embodiments, the sheets 102 can be stacked such that the recessed adhesive zones 112 of any given sheet 102 are completely exposed, even when the sheets 102 are collapsed on top of one another in the stack 101 (see, e.g., the embodiment illustrated in FIGS. 4 and 5). However, in some embodiments, as shown in FIGS. 1-3, the sheets 102 can be stacked such that only a portion of a lower sheet 102 is visible when an upper sheet 102 is collapsed over the lower sheet 102. As a result, in some embodiments, the recessed adhesive zones 112 can be at least partially exposed, such that at least a portion of the adhesive 118 of at least one of the recessed adhesive zones 112 of any sheet 102 can be selectively activated to adhere an article 150 of interest, even while in the stacked and collapsed configuration. The recessed adhesive zones 112 can be exposed across the front surface 104 each sheet 102, and thus, be recessed from the front surface 104 of the sheet 102; and/or the recessed adhesive zones 112 (i.e., an adhesive 118 of each recessed adhesive zone 112) can be exposed across the rear surface 106 of each sheet 102 and thus, be recessed from the rear surface 106 of the sheet 102; or a combination thereof. Generally, each sheet 102 will have all of the recessed adhesive zones 112 of that sheet 102 exposed across the same side of the sheet 102, i.e., the front surface 104 or the rear surface 106. In addition, the stack 101 can be arranged such that each sheet 102 in the stack 101 has the recessed adhesive zones 112 oriented in the same direction as the other sheets 102 in the stack 101 (i.e., toward the top of the stack 101, e.g., exposed across the front surface 104 of the sheet 102; or toward the bottom of the stack 101, e.g., exposed across the rear surface 106 of the sheet 102).

As shown in FIGS. 1-3, in some embodiments, the staggered formation of the recessed adhesive binding system 100 can be formed by binding the binding edge 117 of a plurality of similarly-sized sheets 102 in a splayed or fanned-out configuration, such that the binding edges 117 of the sheets 102 are parallel but spaced a distance apart (e.g., a uniform distance or a non-uniform distance) from one another (e.g., underneath the backing 105 of the binding 103), and such that the exposed edges 108 of the sheets 102 are also parallel and also spaced a distance apart from one another (e.g., uniformly or non-uniformly). As a result, each sheet 102 in the stack 101 extends outwardly from the binding 103 the same distance, because the sheets 102 are all similarly sized in that dimension (i.e., width). Alternatively, as shown in FIGS. 4-5 and described below, sheets 102 of varying sizes can be employed and extend different widths (or depths) outwardly from a binding.

The recessed adhesive zones 112, which can also be referred to as "selectively activated" adhesive zones 112, can be formed in a variety of manners. Because the adhesive 118 is recessed from the front surface 104 of the sheet 102 and/or the rear surface 106 of the sheet 102 in the one or more recessed adhesive zones 112, the adhesive 118 does not adhere to a surface or object positioned adjacent the front surface 104 and/or the rear surface 106 of the sheet 102 until the recessed adhesive 118 is activated, e.g., until the recessed adhesive zone 112 is pressed toward that surface or object. For example, when the adhesive 118 is exposed across the rear surface 106, such as is the case in the recessed adhesive binding system 100 of FIGS. 1-3, the front surface 104 of each sheet 102 can be pressed (e.g., to pivot the sheet 102 about its living hinge 116) in the direction of the rear surface 106 to press the adhesive 118 into contact with the surface or object. In addition, or alternatively, the object can be pressed in an opposite direction into contact with the adhesive 118.

In some embodiments, the adhesive 118 can be recessed from the front surface 104 of the sheet 102 at least partially because the height of the adhesive 118 is less than the thickness of the sheet 102. That is, the thickness of the sheet 102 can be sufficient to space or separate the exposed adhesive 118 on the rear surface 106 of the sheet 102 from another sheet 102 or object contacting the rear surface 106. In some embodiments, the sheet 102 can have a thickness of at least about 0.05 mm, in some embodiments, at least about 0.07 mm, in some embodiments, at least about 0.1 mm, and in some embodiments, at least about 0.25 mm.

As a result, the sheet 102 (and the recessed adhesive binding system 100) can be handled and moved across another surface such as a sheet of paper, a desktop, a countertop, etc. without adhering thereto via the exposed adhesive 118, or without adhering thereto until the desired recessed adhesive zone 112 is activated.

One exemplary type of recessed adhesive zone 112 is shown in FIGS. 1-3 by way of example. In the recessed adhesive binding system 100, each sheet 102 includes one or more openings or cutaway zones 120 formed through the sheet 102 and positioned adjacent the exposed edge 108 of the sheet 102. In embodiments where the sheet 102 includes a plurality of (i.e., at least two) cutaway zones 120, the cutaway zones 120 can be spaced apart (e.g., equally) along the length of the sheet 102 (e.g., along the dimension that extends into and out of the page of FIG. 3). Such a configuration can allow the same sheet 102 to either accommodate multiple articles 150 along its length, or to better adhere a larger article (e.g., such as a letter-sized sheet of paper, or a larger or thicker article). As shown in FIG. 1, in some embodiments, the length of each sheet 102, and generally of the recessed adhesive binding system 100, can be sized to accommodate a sheet of paper, such as a letter-sized (or larger) sheet of paper, such that the recessed adhesive binding system 100 can be used to organize various documents, presentations, reports, or other works.

In some embodiments, as shown in FIG. 1, the length of each sheet 102 of the recessed adhesive binding system 100 is generally greater than its width, and the binding 103 can extend, or be oriented, along the length of the sheets 102.

Each cutaway zone 120 shown in the embodiment of FIGS. 1-3 includes a semi-circle positioned such that the flat edge of the semi-circle is in line with the exposed edge 108 of the sheet 102, the cutaway zone 120 opens to the exposed edge 108, and there is no sheet material present on at least one portion of the cutaway zone 120. However, it should be understood that a variety of cutaway zones 120 can be employed, for example, in which the material of the sheet 102 is present on all sides of the cutaway zone 120. In some embodiments, the sheet 102 is formed of paper, and the cutaway zone 120 can be referred to as a "paperless zone." A variety of shapes of cutaway zones 120 can be employed in the recessed adhesive binding system 100, including, but not limited to, triangles, rectangles, squares, ovals, oblong-shaped cutouts, semicircles, trapezoids, polygons, waves, grooves, notches, scallops (e.g., scalloped edges), other suitable shapes, or combinations thereof.

The recessed adhesive binding system 100 can further include one or more cover sheets (which can also be referred to as "cover layers") 132 positioned adjacent each sheet 102. Each cover sheet 132 includes a front surface 134 and a rear surface 136, and the adhesive (e.g., pressure-sensitive adhesive) 118 disposed on the rear surface 136. In some embodiments, the pressure-sensitive adhesive 118 can be coextensive with the cover sheet 132, or with the rear surface 136 of the cover sheet 132. In some embodiments, a single cover sheet 132 can be employed that is coextensive with the sheet 102, or that is at least sized to cover all of the cutaway zones 120 on one sheet 102; however, in some embodiments, as shown in FIGS. 1 and 3, the cover sheets 132 can each be dedicated to one or more cutaway zones 120 and/or recessed adhesive zones 112. Depending on which surface of the sheet 102 is desired to have the exposed adhesive 118, the cover sheet 132 can be coupled to the opposite surface of the sheet 102. For example, as shown in FIGS. 1-3, in some embodiments, the cover sheet 132 can be adhered to a front surface 104 of the sheet 102 over one or more cutaway zones 120, such that the adhesive 118 is exposed across the cutaway zone(s) 112 and recessed from the rear surface 106 of the sheet 102.

As mentioned above, by employing a recessed adhesive 118, the sheet 102 can be slid relative to other sheets 102, surfaces or objects without adhering to them until one or more recessed adhesive zones 112 are activated. As mentioned above, this non-stick feature can be dependent upon the thickness of the sheet 102 and the height of the adhesive 118; however, this non-stick feature can also be dependent, to some degree, upon the fact that the cover sheet 132 is sufficient strength and/or rigidity so as not to sag appreciably (if at all) into any of the cutaway zones 120 across which it extends, even though it is unsupported across the cutaway zones 120. The size of the cutaway zones 120 can also be controlled to control the "sticky-ness" of each sheet 102. For example, in some embodiments, relatively small (e.g., no greater than 1 cm across) cutaway zones 120 can be employed, and in such embodiments, a larger number of cutaway zones 120 can be employed. The ability of the recessed adhesive binding system 100 (or of each sheet 102) to adhere to various articles or objects thereto can be dictated by the total or overall surface area of exposed and recessed adhesive 118, which can be controlled by controlling the size and/or number of recessed adhesive zones 112.

Activating the recessed adhesive 118 can be manual, such as by pressing against the front surface 104 of the sheet 102 adjacent a recessed adhesive zone 112 with the fingers, palm, or hand of a user, for example, in a direction toward the rear surface 106 of that sheet 102, generally denoted as P (see FIG. 3). While the adhesive 118 is activated to be adhered to another surface, the cover sheet 132 may deform on its front surface 104, although the deformation may not be visually or tactilely appreciable to the user.

The direction of pressure P in FIG. 3 is shown by way of example only; however, it should be understood that pressure P can instead be applied in a direction generally opposite the illustrated direction of P in FIG. 3. For example, the supported article 150 can be pressed in a direction generally opposite that of P until the supported article 150 (and/or the cover sheet 132) flexes and/or deforms enough to allow the adhesive 118 to contact and adhere to the supported article 150. In some embodiments, a combination of pressures in opposing directions and deformations of both the cover sheet 132 and the supported article 150 can be employed to activate the adhesive 118.

In some embodiments, the pressure-sensitive adhesive 118 can provide good adhesion to a surface, while also being removable under moderate force without leaving a residue (e.g., removable and/or repositionable pressure-sensitive adhesives). As a result, in some embodiments, articles that are bound or supported by the recessed adhesive binding system 100 can be easily removed, reorganized, reoriented, repositioned, and/or rearranged in the recessed adhesive binding system 100.

Examples of suitable materials for the adhesive 118 include one or more adhesives based on (meth)acrylates, urethanes, silicones, epoxies, rubber based adhesives (including natural rubber, polyisoprene, polyisobutylene, and butyl rubber, block copolymers, and thermoplastic rubbers), and combinations thereof.

Examples of suitable (meth)acrylates include polymers of alkyl acrylate monomers such as methyl methacrylate, ethyl methacrylate, n-butyl methacrylate, methyl acrylate, ethyl acrylate, n-butyl acrylate, iso-octyl acrylate, iso-nonyl acrylate, 2-ethyl-hexyl acrylate, decyl acrylate, dodecyl acrylate, n-butyl acrylate, hexyl acrylate, and combinations thereof. Examples of commercially available block copolymers include those available under the trade designation "KRATON G-1657" from Kraton Polymers, Westhollow, Tex.

As described above, in some embodiments, the adhesive 118 can include a removable and/or repositionable pressure-sensitive adhesive. An adhesive is considered to be "removable," if after final application to an intended substrate, recessed adhesive binding system 100 can be removed at the end of the intended life of the article at a rate in excess of 7.62 meters/hour (25 feet/hour) by hand with the optional use of heat without damage to either the surface to which it is coupled (e.g., a mounting surface). In some embodiments, the removable pressure-sensitive adhesive has a 180 degree peel strength (from a sheet of 400-gauge Mylar D PET film, available from the E. I. du Pont de Nemours and Company, Wilmington, Del.) of less than 8 N/cm, and more particularly, less than 6 N/cm.

The term "repositionable" generally refers to the ability to be, at least initially, repeatedly adhered to and removed from a surface without substantial loss of adhesion capability. In some embodiments, the repositionable pressure-sensitive adhesive has a 180 degree peel strength, at least initially, of less than about 2 N/cm, in some embodiments, less than about 1 N/cm, and in some embodiments, less than about 0.1 N/cm, when peeled from a sheet of 400-gauge Mylar D PET film, available from the E. I. du Pont de Nemours and Company, Wilmington, Del.

Examples of suitable removable and repositionable pressure-sensitive adhesives include those described in Hobbs et al., U.S. Publication No. 2005/0249791 and Cooprider et al., U.S. Pat. No. 5,571,617, both of which are incorporated herein by reference; and adhesives based on solid inherently tacky, elastomeric microspheres, such as those disclosed in Silver, U.S. Pat. No. 3,691,140, Merrill et al., U.S. Pat. No. 3,857,731, and Baker et al., U.S. Pat. No. 4,166,152; all of which are incorporated herein by reference. Other removable and repositionable pressure-sensitive adhesives that can be employed in the present disclosure include those employing the composite pressure-sensitive adhesive microspheres disclosed in Kesti et al., U.S. Pat. No. 5,824,748, which is incorporated herein by reference.

In some embodiments, the adhesive 118 can be substantially smooth. In some embodiments, the adhesive 118 can be textured or include a topography. A topography can be beneficial for bleeding air out from beneath the sheet 102 as it is applied to a surface, thereby reducing the amount of trapped air pockets beneath the sheet 102. Examples of suitable topographies are discussed in Sher et al., U.S. Pat. No. 6,911,243, which is incorporated herein by reference.

In some embodiments, the thickness of the adhesive 118 can be at least about 10 micrometers, in some embodiments, at least about 20 micrometers, and in some embodiments, at least about 50 micrometers. In some embodiments, the thickness of the adhesive 118 can be no greater than about 300 micrometers, in some embodiments, no greater than about 200 micrometers, and in some embodiments, no greater than about 100 micrometers.

In some embodiments, the front surface 134 of the cover sheet 132 and/or the adhesive 118 can be configured such that the adhesive 118 does not adhere (or does not adhere well) to the front surface 134 of the cover sheet 132. That is, in some embodiments, the adhesive 118 and/or the front surface 134 of the cover sheet 132 can be configured such that the adhesive 118 of cover sheet 132 does not adhere (or does not adhere well) to the front surface 134 of an adjacent cover sheet 132, for example, when the cover sheet(s) 132 are positioned in such a way that the adhesive 118 of one cover sheet 132 is exposed to the front surface 134 of an adjacent cover sheet 132, as shown in FIGS. 1 and 3. As such, the adhesive 118 and/or cover sheet 132 can be configured so as not to unnecessarily wear out the adhesive 118 or cause it to lose its tackiness by adhering to other portions of the recessed adhesive binding system 100 when not in use to bind various articles of interest. For example, in some embodiments, the front surface 134 of the cover sheet 132 can include a release, or releasable, coating. In such embodiments, the front surface 134 of the cover sheet 132 can function as a releasable liner for an adjacent sheet 102/cover sheet 132 set. Examples of release coatings or low adhesion backsize (LAB) materials that can be applied to the rear surface 106 of the sheet 102 can be found in U.S. Pat. Nos. 5,744,207, 5,874,144, 6,352,766, and 6,420,480, which are incorporated herein by reference in their entirety.

The phrase "does not adhere well" can generally refer to the adhesive 118 having a 90 degree peel strength, at least initially, of less than about 50 g, in some embodiments, less than about 30 g, and in some embodiments, less than about 20 g, when a 1-inch-(2.54 cm)-wide strip of the cover sheet 132 having the adhesive 118 (i.e., on its rear surface 136) is peeled from the front surface 134 of an adjacent cover sheet 132.

As a result of the configuration of the recessed adhesive zones 112 in the recessed adhesive binding system 100 of FIGS. 1-3, the rear surface 106 of each of the plurality of sheets 102 in the stack 101 includes the recessed adhesive 118, such that the recessed adhesive 118 of an upper (e.g., first) sheet 102 is exposed to the front surface 104 of a lower (e.g., second) sheet 102, and/or to the front surface 134 of the cover sheet 132 coupled to, or forming a portion of, the second sheet 102. As such, the supported article 150 can be positioned between the rear surface 106 of the upper sheet 102 and the front surface 104 of the lower sheet 102, and adhered to the rear surface 106 of the upper sheet 102 when one or more of the recessed adhesive zones 112 of the upper sheet 102 is activated. In addition, this configuration provides for the recessed adhesive 118 of the upper sheet 102 and the lower sheet 102 to be at least partially exposed toward a rear or bottom of the stack 101, depending on the amount of overlap between the sheets 102. As a result, the bottom- or rear-most sheet 102 in the stack 101 of the recessed adhesive binding system 100 can be coupled to another object, such as a file folder, a hanging file, an album, a wall, a desktop, another suitable mounting surface, or a combination thereof.

FIGS. 4-5 illustrate a recessed adhesive binding system 200 according to another embodiment of the present disclosure, wherein like numerals represent like elements. The recessed adhesive binding system 200 shares many of the same elements and features described above with reference to the illustrated embodiments of FIGS. 1-3. Accordingly, elements and features corresponding to elements and features in the illustrated embodiment of FIGS. 4-5 are provided with the same reference numerals in the 200 series. Reference is made to the descriptions above accompanying FIGS. 1-3 for a more complete description of the features and elements (and alternatives to such features and elements) of the embodiment illustrated in FIGS. 4-5. Any of the features described with respect to the embodiments of FIGS. 1-3 can equally be applied to the embodiment of FIGS. 4-5.

FIGS. 4-5 illustrate the recessed adhesive binding system 200 with a supported article 250 (e.g., a sheet of paper, envelope, etc.) bound in the recessed adhesive binding system 200.

FIG. 4 shows the recessed adhesive binding system 200 in a horizontal configuration (e.g., how the recessed adhesive binding system 200 might be positioned atop a desktop, in a book, in a folder, or the like), and FIG. 5 shows the recessed adhesive binding system 200 in a vertical configuration, for example, mounted to a vertical mounting surface or object 240, such as a wall.

Similar to the recessed adhesive binding system 100 of FIGS. 1-3, the recessed adhesive binding system 200 includes a plurality of sheets 202 arranged in a stack 201, the plurality of sheets 202 held together by a binding 203. Each sheet 202 includes a front surface 204, a rear surface 206, and an exposed edge 208, wherein the rear surface 206 of each sheet 202 is positioned adjacent the front surface 204 of an adjacent sheet 202 (i.e., except for an end sheet 202). Each sheet 202 can also be configured to pivot with respect to the binding 203 (e.g., about its binding edge 217), such that each sheet 202 can be flipped open (e.g., when positioned or mounted horizontally (e.g., flat), such as in a book) or upside-down (e.g., when mounted vertically, as in FIG. 5). In embodiments such as those of FIGS. 4-5, the binding 203 can wrap around at least a portion of the front surface 204 of the upper- or front-most sheet 202 and/or around at least a portion of the rear surface 206 of the lower- or rear-most sheet 202, and in such embodiments, at least a portion of the binding 203 can also move or pivot when the sheets 202 are flipped open (e.g., pivoted about the binding edge 217). That is, as mentioned above, in some embodiments, the binding 203 can be at least somewhat pliable or flexible.

For example, as shown in FIGS. 4 and 5, each sheet 202 can be coupled to the binding 203 via one or more living hinges 216, and each sheet 202 can be pivoted with respect to the other sheets 202 and at least a portion of the binding 203 about the living hinge 216. At least one of the front surface 204 and the rear surface 206 of each of the plurality sheets 202 can include one or more recessed adhesive zones 212 positioned adjacent the exposed edge 208.

The binding 203 can be formed of any of the materials listed above with respect to the binding 103, and can include a backing 205 and a layer of adhesive (e.g., a pressure-sensitive adhesive) 207 adhering the backing 205 to the plurality of binding edges 217 in the stack 201. As shown in FIG. 4, in some embodiments, the backing 205 can have a length substantially equal to, or slightly less than, the length of each of the sheets 202, and a width that is substantially shorter than the width of the each sheet 202, but large enough to contact the plurality of binding edges 217. As mentioned above, the binding 203 of the embodiment of FIGS. 4-5 includes portions that wrap around at least a portion of the top of the stack 201 and at least a portion of the bottom of the stack 201; however, that need not be the case. Instead, the binding 203 can be coupled only to the binding edges 217 of the sheets 202 (e.g., can be formed by painting a binding compound across the stacked binding edges 217, similar to that of a tablet). In such embodiments, the binding 203 may not include a separate backing 205 and adhesive 207.

As shown in FIGS. 4-5, the recessed adhesive binding system 200 can include the plurality of sheets 202 stacked in a staggered configuration such that the exposed edge 208 of each sheet 202 in the stack 201 extends further outwardly from the stack 201 (e.g., from the binding 203) than the exposed edge 208 of an adjacent sheet 202. For example, in the embodiment shown in FIGS. 4-5, the exposed edge 208 of a lower (e.g., second) sheet 202 in the stack 201 extends further outwardly from the stack 201 than an upper (e.g., first) sheet 202 in the stack 201, such that the uppermost sheet 202 in the stack 201 extends the smallest distance out of the stack 201, and the lowermost sheet 202 in the stack 201 extends the largest distance out of the stack 201. However, the opposite configuration can be employed.

In some embodiments, as shown in FIGS. 4-5, the sheets 202 can be stacked such that the recessed adhesive zones 212 of any given sheet 202 are completely exposed, even when the sheets 202 are collapsed on top of one another in the stack 201. As a result, in some embodiments, the recessed adhesive zones 212 can be at least partially exposed, or fully exposed, such as that shown in FIGS. 4-5. As a result, the entire exposed adhesive 218 of at least one of the recessed adhesive zones 212 of any sheet 202 can be selectively activated to adhere an article 250 of interest, even while in the stacked and collapsed configuration. As shown in FIGS. 4-5, in some embodiments, the recessed adhesive zones 212 can be exposed across the front surface 204 each sheet 202.

As shown in FIGS. 4-5, in some embodiments, the staggered formation of the recessed adhesive binding system 200 can be formed by binding the binding edges 217 of a plurality of differently-sized sheets 202 in a level or even configuration, such that the binding edges 217 of the sheets 202 are stacked atop one another. However, as described above, each sheet 202 has a different width (or depth) than an adjacent sheet 202. As a result, even though the sheets 202 are bound to the binding 203 at the same location, each sheet 202 in the stack 201 extends outwardly from the binding 203 a different distance. In some embodiments, a combination of the type of staggering that is employed in the recessed adhesive binding system 100 of FIGS. 1-3 and the type of staggering that is employed in the recessed adhesive binding system 200 of FIGS. 4-5 can be employed.

The recessed adhesive zones 212, which can also be referred to as "selectively activated" adhesive zones 212, can be formed in a variety of manners. Because the adhesive 218 is exposed across the front surface 204 of the sheet 202 (and/or the rear surface 206 of the sheet 202) in the one or more recessed adhesive zones 212, the adhesive 218 does not adhere to a surface or object positioned adjacent the front surface 204 (and/or the rear surface 206) of the sheet 202 until the recessed adhesive 218 is activated, e.g., until the recessed adhesive zone 212 is pressed toward that surface or object. For example, when the adhesive 218 is exposed across the front surface 204, the rear surface 206 of each sheet 202 can be pressed (e.g., to pivot the sheet 202 about its living hinge 216) in the direction of the front surface 204 to press the adhesive 218 into contact with the surface or object. In addition, or alternatively, the object can be pressed in an opposite direction into contact with the adhesive 218.

In some embodiments, as shown in FIGS. 4-5, one or more recessed adhesive zones 212 can be formed by a first raised element 231, a second raised element 233, and a pressure-sensitive adhesive 218 disposed between and/or underneath the first and second raised elements 231 and 233. The distance between the first and second raised elements 231 and 233 is denoted in FIG. 5 as spacing Z, which can be varied to achieve the desired accessibility and/or tackiness of the recessed adhesive zone 212. In the embodiment illustrated in FIGS. 4-5, each of the first and second raised elements 231 and 233 can be elongated and can extend along a length of each sheet. In addition, as shown in FIGS. 4-5, the first and second raised elements 231 and 233 can be positioned adjacent the exposed edge 208 of the respective sheet 202, oriented substantially parallel with one another, and spaced a distance Z apart. In some embodiments, the spacing Z can range from about 0.25 inches (i.e., about 6.4 mm) to about 2.0 inches (about 51 mm). By way of example only, the raised element 231 positioned closest to the exposed edge 208 of the sheet 202 is referred to as the "first" raised element 231, and the raised element 233 positioned further from the exposed edge 208 of the sheet 202 is referred to as the "second" raised element 233.

As shown in FIGS. 4-5, the first and second raised elements 231 and 233 can be adhered to an exposed surface 235 of the adhesive 218. As shown in FIG. 5, the first raised element 231 can have a first application surface 237, and the second raised element 233 can have a second application surface 239. The adhesive 218 and first and second raised elements 231 and 233 can be configured such that the distance from the front surface 204 of each sheet 202 to its first and second applications surfaces 237 and 239 is greater than the distance from the front surface 204 of the sheet 202 to the exposed surface 235 of the adhesive 218. In addition, as shown, first and second raised elements 231 and 233 project outwardly from the exposed surface 235 of the adhesive 218 a standoff distance S1 and S2, respectively. In some embodiments, S1 and S2 can be equal to one another, but they need not be equal, and in some embodiments, one is greater than the other. In some embodiments, the standoff distances S1 and S2 can range from about 0.0005 inches (i.e., about 0.01 mm or 10 microns) to about 0.01 inches (i.e., about 25 mm).

The standoff distances S1 and S2 are configured to be sufficient to space, recess, or separate the exposed surface 235 of the adhesive 218 on the front surface 204 of the sheet 202 from contacting an adjacent surface, allowing the sheet 102 to be handled and moved across an adjacent surface (e.g., an article 250 to be supported in the recessed adhesive binding system 200) without adhering thereto, until the recessed adhesive 218 is activated. As such, the first and second raised elements 231 and 233 effectively provide borders for the respective recessed adhesive zone 212. Furthermore, the standoff distances S1 and S2 generally inhibit the adherence of the exposed surface 235 of the adhesive 218 with another surface in the absence of a threshold level of pressure applied against the rear surface 204 of the sheet 202 adjacent the recessed adhesive zone 212 (i.e., opposite the adhesive 218).

When a threshold level of pressure is applied, however, the sheet 202 can be sufficiently flexible and deformable to allow at least a portion of the exposed surface 235 of the adhesive 218 to contact a desired surface and become adhered thereto. The pressure applied can be manual, such as by pressing against the rear surface 204 of the sheet 202 opposite the adhesive 218 with the fingers, palm, or hand of a user, in a direction generally denoted by P (see FIG. 5). As a result, the sheet 102 may deform, but such deformation may not be visually or tactilely appreciable to the user. The first and second raised elements 231 and 233 may, under pressure P, compress slightly, but still generally retain sufficient height to space or recess the surrounding portions of the sheet 202 from whatever surface to which the adhesive 218 is adhered. In some embodiments, when the recessed adhesive zone 212 is activated, the first and second raised elements 231 and 233 are configured not to completely collapse.

The direction of pressure P in FIG. 5 is shown by way of example only; however, it should be understood that pressure P can instead be applied in a direction generally opposite the illustrated direction of P in FIG. 5. For example, the supported article 250 can be pressed in a direction generally opposite that of P until the supported article 250 (and/or the sheet 202) flexes and/or deforms enough to allow the adhesive 218 to contact and adhere to the supported article 250. In some embodiments, a combination of pressures in opposing directions and deformations of both the sheet 202 and the supported article 250 can be employed to activate the adhesive 218.

Other configurations of the recessed adhesive zones 212 are possible and within the spirit and scope of the present disclosure. For example, in some embodiments, the raised elements 231 and 233 are not positioned atop a portion of the adhesive 218, but rather the adhesive 218 extends solely between the first and second raised elements 231 and 233. In such embodiments, the above description still applies, except that the standoff distances S1 and S2 are measured with respect to the front surface 204 of the sheet 202, instead of with respect to the exposed surface 235 of the adhesive 218. In addition, in some embodiments, instead of the first and second raised elements 231 and 233 each being elongated along the length of the sheet 202, each of the first and second raised elements 231 and 233 can include a plurality of elements that are lined up end-to-end along the length of the sheet 202, and/or are spaced a distance apart along the length of the sheet 202. In addition, in some embodiments, each recessed adhesive zone 212 can include more than two raised elements 231 and 233, such that the adhesive 218 can include more than one exposed surface 235. Alternatively, or in addition, each sheet 202 can include a plurality of recessed adhesive zones 212 located along its length and/or its width. Other variations of the recessed adhesive zones 212 are possible and can include any of the features and elements of the securing mechanisms of U.S. Patent Publication No. 2006/0188710 (Windorski et al.).

The recessed adhesive zones 212 are described above as being exposed across the front surface 204 of each sheet 202; however, it should be understood that instead, or additionally, the recessed adhesive binding system 200 can include recessed adhesive zones 212 that are exposed across the rear surface 206 of one or more of the sheets 202.

In embodiments in which the recessed adhesive zone 212 extends along a substantial portion of the length of each sheet 202, the same sheet 202 can accommodate multiple articles 250 along its length, or can better adhere a larger article (e.g., such as a letter-sized sheet of paper, or larger). As shown in FIG. 4, in some embodiments, the length of each sheet 202 (and generally of the recessed adhesive binding system 200) and/or the length of each recessed adhesive zone 212, can be sized to accommodate a sheet of paper, such as a letter-sized (or larger) sheet of paper, such that the recessed adhesive binding system 200 can be used to organize various documents, presentations, reports, or other works.

In some embodiments, as shown in FIG. 4, the length of each sheet 202 of the recessed adhesive binding system 200 is generally greater than its width, and the binding 203 can extend, or be oriented, along the length of the sheets 202.

The first and second raised elements 231 and 233 are shown by way of example only as having generally parallelogram-shaped (e.g., rectangular, square, etc.) cross-sectional shapes. However, it should be understood that the first and second raised elements 231 and 233 can have a variety of cross-sectional including, but not limited to, semi-circles, triangles, polygons, ovals, other suitable shapes, or combinations thereof.

Furthermore, the adhesive 218 can generally include any of the variety of materials and adhesive types described above with respect to the adhesive 118.

As a result of the configuration of the recessed adhesive zones 212 in the recessed adhesive binding system 200 of FIGS. 4-5, the front surface 204 of each of the plurality of sheets 202 in the stack 201 includes the recessed adhesive 218, such that the supported article 250 can be positioned between the rear surface 206 of an upper (e.g., first) sheet 202 and the front surface 204 of a lower (e.g., second) sheet 202, and adhered to the front surface 204 of the lower sheet 202 when one or more recessed adhesive zones 212 of the lower sheet 202 is activated. In addition, this configuration provides for the recessed adhesive 218 of the lower sheet 202 and the upper sheet 202 to be at least partially (or even completely) exposed toward a front or top of the stack 201, depending on the amount of overlap between the sheets 202. As a result, the top- or front-most sheet 202 in the stack 201 of the recessed adhesive binding system 200 can be coupled to another object, such as a file folder, a hanging file, an album, a wall, a desktop, another suitable mounting surface, or a combination thereof.

Alternatively, as shown in FIG. 5, the recessed adhesive binding system 200 can be coupled to the mounting surface or object 240 using a variety of known means, such as adhesives, nails, removable adhesive systems available under the trade designation "COMMAND" from 3M Company, St. Paul, Minn., or the like, or combinations thereof. For example, as shown in FIG. 5, in some embodiments, an additional adhesive 209 can be used to couple at least a portion of the binding 203 (and/or the bottom- or rear-most sheet 202 in the stack 201) to the mounting surface 240.

The recessed adhesive binding systems 100 and 200 are each illustrated by way of example only, and it should be understood that a variety of recessed adhesive binding systems employing various combinations of the features and elements of the recessed adhesive binding systems 100 and 200 also fall within the spirit and scope of the present disclosure. In addition, any combination of the features and elements described above and illustrated in FIGS. 1-5 can be employed in one recessed adhesive binding system of the present disclosure.

The following is a description of various embodiments of the present disclosure.

EMBODIMENTS

Embodiment 1 is a recessed adhesive binding system, the system comprising:

a plurality of sheets arranged in a stack having a binding, each of the plurality of sheets having a front surface, a rear surface, and an exposed edge, wherein the rear surface of a first sheet in the plurality of sheets is positioned adjacent the front surface of a second sheet in the plurality of sheets, wherein each of the plurality of sheets is configured to pivot about the binding, wherein at least one of the front surface and the rear surface of each of the plurality sheets includes at least one recessed adhesive positioned adjacent the exposed edge to form an at least partially exposed recessed adhesive, wherein the at least one recessed adhesive is selectively activated, and wherein the exposed edges of the plurality of sheets are staggered, such that the exposed edge of the second sheet extends further outwardly from the stack than the exposed edge of the first sheet in the stack.

Embodiment 2 is the system of embodiment 1, wherein the rear surface of each of the plurality of sheets includes the at least one recessed adhesive, such that the at least one recessed adhesive of the first sheet is exposed to the front surface of the second sheet.

Embodiment 3 is the system of embodiment 2, further comprising a supported article positioned between the rear surface of the first sheet and the front surface of the second sheet, wherein the supported article is adhered to the rear surface of the first sheet when the at least one recessed adhesive is activated.

Embodiment 4 is the system of any of embodiments 1-3, wherein the front surface of each of the plurality of sheets includes the at least one recessed adhesive, such that the at least one recessed adhesive of the first sheet and the second sheet is at least partially exposed toward a front of the stack.

Embodiment 5 is the system of embodiment 4, further comprising a supported article positioned adjacent the front surface of at least one of the plurality of sheets, wherein the supported article is adhered to the front surface of a sheet when the at least one recessed adhesive of the sheet is activated.

Embodiment 6 is the system of embodiment 3 or 5, wherein the supported article is a sheet of paper.

Embodiment 7 is the system of any of embodiments 1-6, wherein the at least one recessed adhesive of at least one sheet of the plurality of sheets is formed by:

at least one cutaway zone positioned adjacent the exposed edge of the at least one sheet, a cover sheet positioned adjacent at least one of the front surface and the rear surface of the at least one sheet, and a layer of pressure-sensitive adhesive adhering the cover sheet to the at least one of the front surface and the rear surface and extending across the at least one cutaway zone.

Embodiment 8 is the system of any of embodiments 1-7, wherein the at least one recessed adhesive of at least one sheet of the plurality of sheets is formed by:

a first raised element, the first raised element being raised a first height from the front surface or the rear surface of the at least one sheet, a second raised element, the second raised element being raised a second height from the same front surface or rear surface as the first raised element, wherein the first raised element and the second raised element are aligned generally parallel to and spaced apart from one another, and a pressure-sensitive adhesive positioned between the first raised element and the second raised element, such that the pressure-sensitive adhesive has a height, as measured from its exposed surface to the front surface or rear surface of the at least one sheet, that is less than the first height and the second height.

Embodiment 9 is the system of embodiment 8, wherein the first height is the same as the second height.

Embodiment 10 is the system of any of embodiments 1-9, wherein each of the plurality of sheets has a width and a length longer than the width, and wherein the length of each of the plurality of sheets includes at least two recessed adhesives.

Embodiment 11 is the system of any of embodiments 1-10, wherein only the rear surface of each of the plurality of sheets includes the at least one recessed adhesive.

Embodiment 12 is the system of any of embodiments 1-10, wherein only the front surface of each of the plurality of sheets includes the at least one recessed adhesive.

Embodiment 13 is the system of any of embodiments 1-12, wherein each of the plurality of sheets has a width defined between the binding and the exposed edge and a length longer than the width, and wherein the binding extends along the length of the plurality of sheets.

Embodiment 14 is the system of any of embodiments 1-13, wherein each of the plurality of sheets has a width defined between the binding and the exposed edge, wherein the width of the first sheet is less than the width of the second sheet.

Embodiment 15 is the system of embodiment 14, wherein the rear surface of the second sheet is positioned adjacent the front surface of a third sheet in the plurality of sheets, and wherein the width of the second sheet is less than the width of the third sheet.

Embodiment 16 is the system of any of embodiments 1-15, wherein each of the plurality of sheets has a width and a length, the width defined between the exposed edge and a binding edge, wherein the plurality of sheets has the same width, and wherein the binding includes a backing and a layer of adhesive adhering the backing to the binding edges of the plurality of sheets.

Embodiment 17 is the system of embodiment 16, wherein the backing has a width shorter than the width of each of the plurality of sheets and a length substantially equal to the length of each of the plurality of sheets.

Embodiment 18 is the system of embodiment 16 or 17, wherein the length of each of the plurality of sheets is longer than its width.

The embodiments described above and illustrated in the figures are presented by way of example only and are not intended as a limitation upon the concepts and principles of the present disclosure. As such, it will be appreciated by one having ordinary skill in the art that various changes in the elements and their configuration and arrangement are possible without departing from the spirit and scope of the present disclosure. Various features and aspects of the present disclosure are set forth in the following claims.

What is claimed is:

1. A recessed adhesive binding system, the system comprising: plurality of sheets arranged in a stack having a binding, each of the plurality of sheets having a front surface, a rear surface, a binding edge and an exposed edge, wherein each of the plurality of sheets has a width and a length, the width defined between the exposed edge and a binding edge, wherein the plurality of sheets has the same width, wherein the binding edge of each of the plurality of sheets is configured to pivot about the binding, wherein at least one of the front surface and the rear surface of each of the plurality sheets includes at least one recessed adhesive positioned adjacent the exposed edge to form an at least partially exposed recessed adhesive, wherein the at least one recessed adhesive is selectively activated, wherein the rear surface of a first sheet in the plurality of sheets is positioned adjacent the front surface of a second sheet in the plurality of sheets, and wherein the exposed edges of the plurality of sheets are staggered, such that the exposed edge of the second sheet extends further outwardly from the stack than the exposed edge of the first sheet in the stack, wherein the rear surface of each of the plurality of sheets includes the at least one recessed adhesive, such that the at least one recessed adhesive of the first sheet is exposed to the front surface of the second sheet.

2. The system of claim 1, further comprising a supported article positioned between the rear surface of the first sheet and the front surface of the second sheet, wherein the supported article is adhered to the rear surface of the first sheet when the at least one recessed adhesive is activated.

3. The system of claim 2, wherein the supported article is a sheet of paper.

4. The system of claim 1, wherein the at least one recessed adhesive of at least one sheet of the plurality of sheets is formed by:

at least one cutaway zone positioned adjacent the exposed edge of the at least one sheet, a cover sheet positioned adjacent the front surface of the at least one sheet, and a layer of pressure-sensitive adhesive adhering the cover sheet to the front surface and extending across the at least one cutaway zone.

5. The system of claim 1, wherein the length of each of the plurality of sheets includes at least two recessed adhesives.

6. The system of claim 1, wherein only the rear surface of each of the plurality of sheets includes the at least one recessed adhesive.

7. The system of claim 1, wherein each of the plurality of sheets is longer than the width, and wherein the binding extends along the length of the plurality of sheets.

8. The system of claim 1, wherein the binding includes a backing and a layer of adhesive adhering the backing to the binding edges of the plurality of sheets.

9. The system of claim 1, wherein the at least one recessed adhesive of at least one sheet of the plurality of sheets is formed by: a first raised element, the first raised element being raised a first height from the rear surface of the at least one sheet, a second raised element, the second raised element being raised a second height from the rear surface, wherein the first raised element and the second raised element are aligned generally parallel to and spaced apart from one another, and a pressure-sensitive adhesive positioned between the first raised element and the second raised element, such that the pressure-sensitive adhesive has a height, as measured from its exposed surface to the rear surface of the at least one sheet, that is less than the first height and the second height.

10. The system of claim 9, wherein the first height is the same as the second height.

11. A recessed adhesive binding system, the system comprising: a plurality of sheets arranged in a stack having a binding, each of the plurality of sheets having a front surface, a rear surface, and an exposed edge, wherein each of the plurality of sheets is configured to pivot about the binding, wherein at least one of the front surface and the rear surface of each of the plurality sheets includes at least one recessed adhesive positioned adjacent the exposed edge to form an at least partially exposed recessed adhesive, wherein the at least one recessed adhesive is selectively activated, wherein the rear surface of a first sheet in the plurality of sheets is positioned adjacent the front surface of a second sheet in the plurality of sheets, and wherein the exposed edges of the plurality of sheets are staggered, such that the exposed edge of the second sheet extends further outwardly from the stack than the exposed edge of the first sheet in the stack, wherein the front surface of each of the plurality of sheets includes the at least one recessed adhesive, such that the at least one recessed adhesive of the first sheet and the second sheet is at least partially exposed toward a front of the stack.

12. The system of claim 11, further comprising a supported article positioned adjacent the front surface of at least one of the plurality of sheets, wherein the supported article is adhered to the front surface of a sheet when the at least one recessed adhesive of the sheet is activated.

13. The system of claim 11, wherein the at least one recessed adhesive of at least one sheet of the plurality of sheets is formed by:

a first raised element, the first raised element being raised a first height from the front surface of the at least one sheet, a second raised element, the second raised element being raised a second height from the front surface, wherein the first raised element and the second raised element are aligned generally parallel to and spaced apart from one another, and a pressure-sensitive adhesive positioned between the first raised element and the second raised element, such that the pressure-sensitive adhesive has a height, as measured from its exposed surface to the front surface of the at least one sheet, that is less than the first height and the second height.

14. The system of claim 13, wherein the first height is the same as the second height.

15. The system of claim 11, wherein only the front surface of each of the plurality of sheets includes the at least one recessed adhesive.

16. The system of claim 11, wherein each of the plurality of sheets has a width defined between the binding and the exposed edge, wherein the width of the first sheet is less than the width of the second sheet.

17. The system of claim 11, wherein the at least one recessed adhesive of at least one sheet of the plurality of sheets is formed by: at least one cutaway zone positioned adjacent the exposed edge of the at least one sheet, a cover sheet positioned adjacent the rear surface of the at least one sheet, and a layer of pressure-sensitive adhesive adhering the cover sheet to the rear surface and extending across the at least one cutaway zone.

18. The system of claim 11, wherein each of the plurality of sheets has a width and a length, the width defined between the exposed edge and a binding edge, and wherein the binding includes a backing and a layer of adhesive adhering the backing to the binding edges of the plurality of sheets.

* * * * *